United States Patent [19]

Brown

[11] 4,351,213

[45] Sep. 28, 1982

[54] PLAYER FOR DIGITALLY RECORDED MUSIC

[75] Inventor: Paul C. Brown, Arlington, Tex.

[73] Assignee: Convey, Inc., Irving, Tex.

[21] Appl. No.: 67,783

[22] Filed: Aug. 20, 1979

[51] Int. Cl.[3] ..... G10H 5/10

[52] U.S. Cl. ..... 84/1.01; 84/DIG. 10

[58] Field of Search ..... 84/1.01, 1.11, 1.13, 84/1.19, 1.26, DIG. 10

[56] References Cited

U.S. PATENT DOCUMENTS

| | | | |
|---|---|---|---|
| 3,821,714 | 6/1974 | Tomisawa et al. | 84/1.01 X |
| 3,977,291 | 8/1976 | Southard | 84/1.13 |
| 4,014,238 | 3/1977 | Southard | 84/1.13 |
| 4,079,334 | 3/1978 | Hamilton | 84/DIG. 10 |
| 4,119,005 | 10/1978 | Kondo et al. | 84/1.01 |

*Primary Examiner*—Stanley J. Witkowski

*Attorney, Agent, or Firm*—Kanz & Timmons

[57] ABSTRACT

An apparatus (10) for transforming digital data stored in a memory (18) into sounds is disclosed. The apparatus includes an oscillator (12) which drives an address selector (14). The address selector drives the memory. A note generator (20) generates an analog electrical signal responsive to the memory, and a speaker with its associated amplifier stages (22) produces sounds corresponding to the analog electrical signal.

A preferred arrangement of the note generator includes an inverting amplifier which can simply be a logic gate (44) and a plurality of resistors (50) selected by switches (56) in feedback relationship with the amplifier.

A preferred arrangement includes a duty cycle selector (80) to produce harmonics of the fundamental frequency of the analog electrical signal.

9 Claims, 1 Drawing Figure

PLAYER FOR DIGITALLY RECORDED MUSIC

DESCRIPTION

TECHNICAL FIELD

The present invention relates generally to electronic devices for playing music such as record players and tape players and, in one of its aspects, to an electronic apparatus for playing music which has been digitally recorded.

There are many well known advantages of digital recording over analog recording on such media as tapes, disks and records. In general, the information can be stored longer and more reliably in digital form than in analog form. Digital recording will generally not pick up noise with aging and use as do analog recordings. Some electronic storage media such as bipolar, FET, or bubble memory do not lend themselves at all to analog storage.

The normal and accepted method for digitally recording an analog signal is to make an analog to digital conversion of the signal at a certain sampling rate where the sampling rate is sufficiently high to reproduce the signal to a given accuracy. In order to reproduce the analog signal, the process is reversed, going through a digital to analog conversion to reconstruct the analog signal. One possible method for recording and storing music digitally, is to create an analog electrical signal representive of music to be recorded, then converting that analog signal into a digital signal in a conventional manner by analog to digital converter. The sampling rate would need to be at least twice the frequency of the highest frequency needed to be recorded. In order to record up to fifteen thousand hertz, it is necessary to sample at a rate of thirty thousand samples per second. In all, one million eight hundred thousand samples would have to be taken and recorded in order to record a one minute song.

BACKGROUND ART

The only prior art known to the inventor is a device which includes one memory for the song to be played and a separate memory for the notes to be selected from. Both memories are driven by counters, and the output of the memories are matched. Each time a match occurs a flip flop is set. A flip flop is reset by the high speed oscillator that drives the note counter. A low speed oscillator, in the order of 10 to 20 hertz, drives the song counter. The note memory contains the code for a particular frequency in different memory locations so that matches with that particular frequency occur at that frequency rate as the note counter cycles through the note memory.

DISCLOSURE OF THE INVENTION

In accordance with the present invention for transforming digital data stored in a memory into sounds, a low speed oscillator drives an address selector which sequentially selects memory addresses for the stored digital data. A note generator for generating an analog electrical signal is responsive to a memory for the digital data. The fundamental frequency of the analog electrical signal of the note generator is determined by the output of the memory. A means responsive to the note generator produces sounds corresponding to the analog electrical signals. One arrangement of the note generator includes the combination of an inverting amplifier, a plurality of resistors, and means for selectively connecting different combinations of resistors from the plurality between the input and the output of the inverting amplifier. The resistors are selected in response to the memory. An analog electrical signal is generated at the output of the inverting amplifier.

One arrangement of the player includes a means for selecting the duty cycle of the analog electrical signal so that the means for producing sounds corresponding to the analog electrical signal produces sounds having harmonics of the fundamental frequency.

One arrangement includes a connectorized programmable read only memory for the digital data. The memory is connected to a connector receptacle in the means for receiving the memory.

These and other objects, advantages and features of this invention will be apparent from the following description taken with reference to the accompanying drawings, wherein is shown the preferred embodiments of the invention.

BEST MODE FOR CARRYING OUT THE INVENTION

Figure 1:
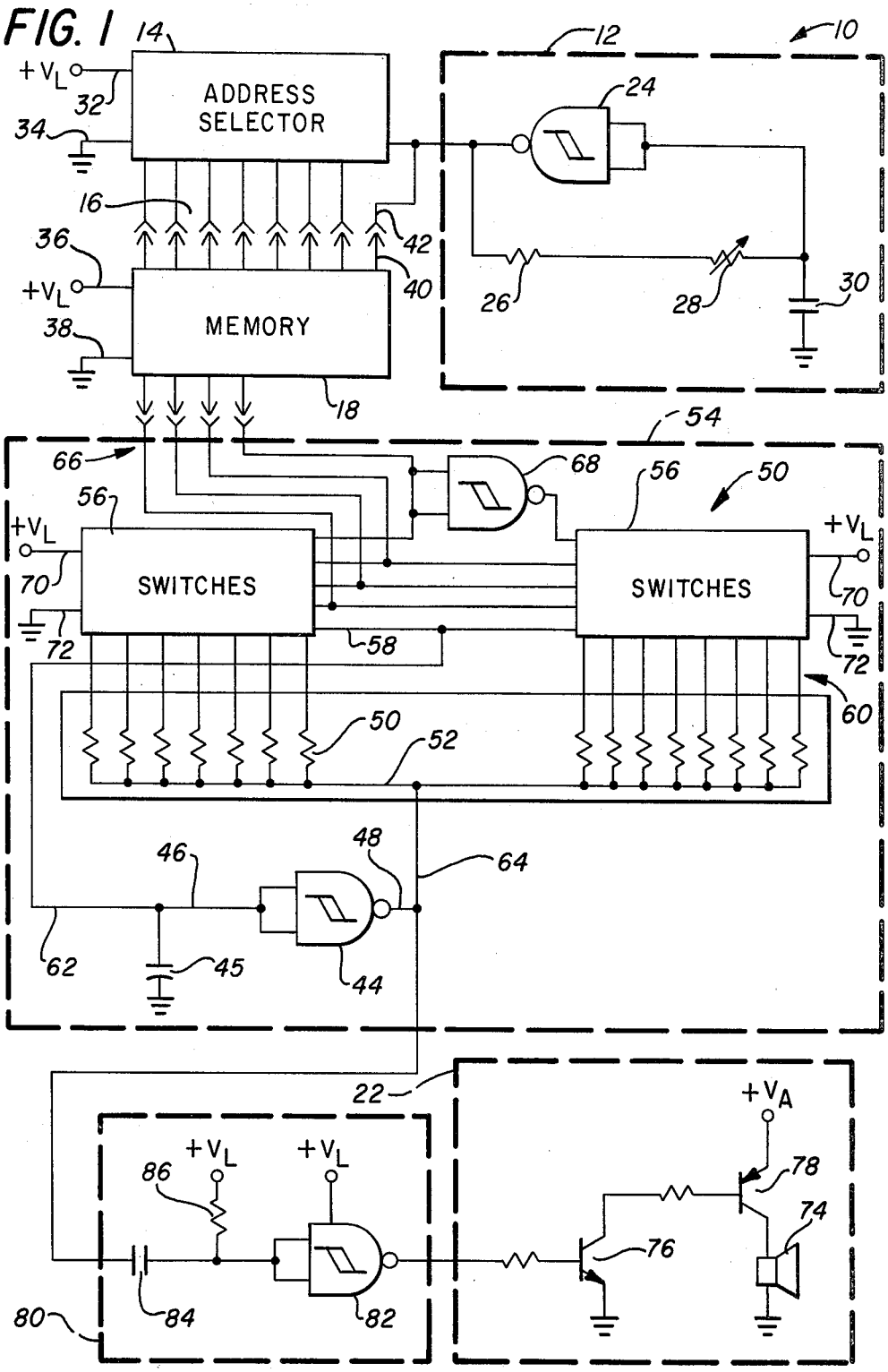
FIG. 1 is a circuit diagram of a player for digitally recorded music according to the present invention.

Referring now to the drawings, one embodiment of an apparatus according to the present invention for transforming digital data stored in a memory into sounds is referred to generally by a reference numeral 10. Apparatus 10 is a digitally recorded music player and includes an oscillator 12, an address selector 14 driven by oscillator 12, a means 16 for receiving a memory 18 for the digital data, a note generator 20 for generating an analog electrical signal responsive to memory 18, and a means 22 responsive to note generator 20 for producing sounds corresponding to the analog electrical signal.

One arrangement of oscillator 12 includes inverting logic gate 24 and the series combination of 68 K ohm resistor 26 and variable 100 K ohm resistor 28 in feedback relationship to NAND gate 24. A 10 microfarad capacitor 30 connects the input of NAND gate 24 to ground.

Address selector 14 in this embodiment is an 8 bit counter which sequentially addresses all 256 addresses of memory 18. Address selector 14 has connections for logic power $V_L$ and ground, 32 and 34 respectively. Memory 18 also has connections for logic power $V_L$ and ground, 36 and 38 respectively. Typically, memory 18 will by packaged in a dual in-line package known as a DIP with a connector 40 affixed to memory 18 for electrically connecting the memory to a connector receptacle 42.

A preferred form of note generator 20 includes the combination of an inverter which can simply be logic gate 44 having an input 46 and an output 48. A capacitor 45 is connected between input 46 and ground. Note generator 20 also includes a plurality of resistance means 50 which in this case is an array of film resistors, and a means 52 for electrically connecting resistors 50 at one end of each resistor. A means 54 for selectively connecting differing combinations of resistors 50 includes the combination of a plurality of two terminal electrical switches 56 such as MOSFET switches, and a means 58 for electrically connecting switches 56 at one terminal of each switch. A means 60 electrically connects the second terminal of each switch 56 to the second terminal of at least one resistor 50, and a means comprising wire 62 and wire 64 electrically connects the combination of resistors and switches between input 46 and output 48 of logic gate 44. The combination of the plurality of resistors 50 and the means for selectively connecting differing combinations of resistors between the output and the input of inverting amplifier 44 is one variable resistance means. The variable resistance means is responsive to memory 18 since switches 56 are addressed by leads 66. The logic level of one of the leads 66 is inverted by logic gate 68 to go to the second bank of switches. Connections 70 and 72 for power and ground are provided for switches 56. Power and ground connections for logic gates 24, 68, and 44 are not shown.

Means 22 for producing sounds corresponding to the analog electrical signal includes speakers 74 driven by the amplifier of transistors 76 and 78 responsive to note generator 20. The amplifier is powered by voltage $V_A$. Typical values for $V_A$ and $V_L$ would be 12 volts and 5 volts respectively.

In a preferred embodiment, a means 80 for selecting the duty cycle of the analog electrical signal is connected in the signal path between output 48 of logic gate 44 and means 22 for producing sounds so that means 22 for producing sounds corresponding to an analog electrical signal produces sounds having harmonics of the fundamental frequency of the analog electrical signal. One means 80 for selecting the duty cycle of the analog electrical signal is a one-shot multivibrator comprising NAND gate 82 and capacitor 84 connecting the output of gate 48 to the input of gate 82. Means 80 is powered by the logic voltage $V_L$, supplying gate current through resistor 86.

It can thus be seen, that if a memory 18 is plugged into means 16 for receiving the memory, address selector 14 driven by oscillator 12 will slowly cycle through memory 18, typically in the 10 to 20 hertz range. As the addresses in memory 18 are selected, the contents of the currently selected address closes certain switches 56 and opens others, thus selecting certain values of resistance to be put in a feedback relationship to logic gate 44. Since logic gate 44 is an inverting logic gate, in this case a NAND gate, and the value of capacitor 45 is fixed, the rate at which the voltage on output 48 oscillates is determined by the value of resistance selected by means 54 through selecting different combinations of resistors 50. The analog electrical signal at output 48 thus oscillates at a selected frequency which can be varied by selecting different resistance values for the feedback loop. The fundamental frequency of the substantially rectangular analog signal at output 48 is thus selected by the value in the memory address at any particular instant in time. Since the main component of the analog signal at output 48 is just the fundamental frequency, driving the means for converting an analog signal into sounds from that point would create sounds of primarily a single frequency which would be a harsh sound. In order to get the pleasant sounds of the various harmonics, the signal goes through means 80 which is a one-shot multivibrator in this case, which changes the duty cycle of the signal, thus creating harmonics of the fundamental frequency.

Varying the duty cycle of the analog electrical signal can also be used to vary the volume of the output. Alternatively, one or two bits of each word in memory can be used as volume bits to control the amount of amplification by means 22 for producing sounds.

The particular embodiment shown, only generates a single frequency and its harmonics at any one time, but other note generators 20 can be driven in parallel by memory 18 with some bits of each word selecting the oscillation frequency of one note generator and other bits selecting the oscillation frequencies of other note generators. The signals can then be recombined after passing through their respective means 80 for selecting the duty cycle of the analog electrical signal prior to entering a common means 22 for producing sounds.

Since speaker 74 will primarily just be driven in one direction from its rest position in the arrangement shown, the speaker can be wired so that its rest position is at one extreme end of its travel range. The system described is very energy efficient since the speaker will be completely at a rest position when no signal is present. Since the speaker will be in a constant off when there is no signal, the speaker is not heated unnecessarily.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set fourth or shown in the accompanying drawings is to be interpreted as illustrative and not in a limiting sense.

I claim:

1. An apparatus for transforming digital data stored in an addressable memory into sounds, comprising in combination:

an oscillator;

an address selector driven by the oscillator for selecting an address in the memory;

an inverter having an input and an output;

a plurality of resistance means;

means for selectively connecting differing combinations of resistance means from the plurality wherein a particular combination of resistance means is electrically connected between the input and the output of the inverter responsive to the digital data stored in the memory at the address selected by the address selector whereby an analog electrical signal is generated at the output of the inverter wherein the analog electrical signal is determined by the digital data stored in the memory; and means responsive to the inverter for producing sounds corresponding to the analog electrical signal.

2. An apparatus according to claim 1 wherein the inverter comprises an inverting logic gate whereby the analog signal is substantially rectangular, further comprising means for selecting the duty cycle of the analog electrical signal whereby the means for producing sounds corresponding to the analog electrical signal produces sounds having harmonics of the fundamental frequency of the analog electric signal.

3. An apparatus according to claim 2 further comprising a connector receptacle electrically connected to the means for selectively connecting differing combinations of resistance means and a connector affixed to the memory for electrically connecting the memory to the connector receptacle.

4. An apparatus according to claim 1 further comprising a connector receptacle electrically connected to the means for selectively connecting differing combinations of resistance means and a connector affixed to the memory for electrically connecting the memory to the connector receptacle.

5. In an apparatus for transforming digital data stored in a memory into sounds, of the type having an oscillator, an address selector for driving the memory, and a means for producing sounds corresponding to an analog electrical signal, the combination comprising:

an inverter having an input from the memory for the digital data to be converted into sounds and an output;

a variable resistance means connected between the output and the input of the inverter and responsive to the memory whereby an analog electrical signal is generated at the output of the inverter for driving the means for producing sounds.

6. A combination according to claim 5 wherein the variable resistance means comprises, in combination:

a plurality of resistance means; and a means for selectively connecting differing combinations of resistance means from the plurality wherein the combinations are connected between the output and the input of the inverter responsive to the memory.

7. A combination according to claim 6 wherein the inverter comprises an inverting logic gate whereby the analog signal is substantially rectangular, further comprising means for selecting the duty cycle of the analog electrical signal connected in the signal path between the output of the inverter and the means for producing sounds whereby the means for producing sounds corresponding to an analog electrical signal produces sounds having harmonics of the fundamental frequency of the analog electrical signal.

8. A combination according to claim 6 wherein the inverter comprises an inverting logic gate, the plurality of resistance means comprises the combination of a plurality of film resistors and a means for electrically connecting the resistors at one end of each resistor, and the means for selectively connecting differing combinations of resistance means comprises the combinations of a plurality of two terminal electrical switches and a means for electrically connecting the switches at one terminal of each switch, further comprising:

a means for electrically connecting the second terminal of each switch to the second end of at least one resistor; and a means for electrically connecting the combination of resistors and switches between the input and the output of the logic gate.

9. A combination according to claim 8 further comprising a one-shot multivibrator connected in the signal path between the output of the logic gate and the means for producing sounds whereby the means for producing sounds corresponding to an analog electrical signal produces sounds having harmonics of the fundamental frequency of the analog electrical signal for at least some frequencies.

* * * * *